US012644681B2

(12) United States Patent
Ahn et al.

(10) Patent No.: US 12,644,681 B2
(45) Date of Patent: Jun. 2, 2026

(54) SIMULTANEOUS IGNITION METHOD FOR HOLLOW MODULAR CHARGE USING CLUSTER LASER

(71) Applicant: AGENCY FOR DEFENSE DEVELOPMENT, Daejeon (KR)

(72) Inventors: Sang-Tae Ahn, Daejeon (KR); Yong-Seon Lee, Daejeon (KR); Yun-Jung Oh, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 18/955,118

(22) Filed: Nov. 21, 2024

(65) Prior Publication Data

US 2025/0377190 A1 Dec. 11, 2025

(30) Foreign Application Priority Data

Jun. 11, 2024 (KR) ..... 10-2024-0075392

(51) Int. Cl.
*F42B 3/113* (2006.01)

(52) U.S. Cl.
CPC ..... *F42B 3/113* (2013.01)

(58) Field of Classification Search
CPC ..... F42B 3/113
USPC ..... 102/201
See application file for complete search history.

(56) References Cited

U.S. PATENT DOCUMENTS

| | | | | |
|---|---|---|---|---|
| 5,212,339 | A | 5/1993 | Piltch | |
| 5,229,542 | A * | 7/1993 | Bryan | F42B 12/204 102/478 |
| 5,460,407 | A | 10/1995 | Stuckle | |
| 2003/0047101 | A1 | 3/2003 | Folsom et al. | |
| 2009/0158952 | A1 | 6/2009 | Gruber | |

FOREIGN PATENT DOCUMENTS

| | | | | |
|---|---|---|---|---|
| DE | 19719273 | A1 * | 2/1998 | F42B 3/113 |
| DE | 299 20 266 | U1 | 4/2000 | |
| DE | 19946324 | A1 * | 3/2001 | F41A 19/63 |
| DE | 102019003222 | A1 * | 11/2020 | F42B 12/10 |
| EP | 0916068 | B1 | 11/2001 | |

OTHER PUBLICATIONS

Search Report dated Oct. 8, 2025, in European Patent Application No. 24218439.8.

* cited by examiner

*Primary Examiner* — Bret Hayes
(74) *Attorney, Agent, or Firm* — LRK PATENT LAW FIRM

(57) ABSTRACT

A simultaneous ignition method for a hollow modular charge using a cluster laser according to the present invention can maximize an intensity of a laser beam per unit area radiated to a gunpowder coating part (39) by adjusting a path of the laser beam from first, second, third, fourth, fifth, and sixth laser oscillators (11, 12, 13, 14, 15, 16) igniting the gunpowder coating parts (39) through one-to-one matching with unit charges Nos. 1, 2, 3, 4, 5, and 6 (31, 32, 33, 34, 35, 36) having a charge inner diameter (38) as they goes away due to the linear arrangement of the unit charges Nos. 1, 2, 3, 4, 5, and 6 (31, 32, 33, 34, 35, 36), thereby simultaneously igniting a plurality of lasers in a cluster-shaped combination.

6 Claims, 2 Drawing Sheets

<POSITION OF OSCILLATOR IN POLAR COORDINATE SYSTEM>

<POSITION OF OSCILLATOR
IN POLAR COORDINATE SYSTEM>

<PATH FOR EACH LASER BEAM RADIATION DIRECTION>

SIMULTANEOUS IGNITION METHOD FOR HOLLOW MODULAR CHARGE USING CLUSTER LASER

CROSS REFERENCE TO RELATED APPLICATION

The present application claims priority to Korean Patent Application No. 10-2024-0075392, filed Jun. 11, 2024, the entire content of which is incorporated herein for all purposes by this reference.

BACKGROUND OF THE INVENTION

1. Field of the Invention

The present invention relates to a laser ignition method, and more specifically, to a simultaneous ignition method for a hollow modular charge using a cluster laser, in which simultaneous firing of lasers ignites all unit charges at the same time.

2. Description of Related Art

In general, laser ignition methods of an artillery ignite a propelling charge using a high-power laser, and this laser ignition solves a problem of a detonator hit ignition method.

The detonator hit ignition method is a "detonator+hit-type triggering device" and has problems such as the possibility of misfire due to intermittent defects in a detonator (in particular, a detonator cup), the instability of a triggering device with a hit-type triggering method, and restrictions on the automation of an artillery operation.

For example, the laser ignition method uses two types of propelling charges, one of which is a propelling charge with a central igniter and a bottom igniter filled with black powder and the other is a hollow propelling charge.

However, the hollow propelling charge experiences a relatively long ignition delay when irradiated with a single spot laser beam.

To overcome this, efforts were made to expand a laser beam radiation length/area by changing the single spot laser to an annular laser or linear laser, but it was not possible to ignite all unit charges (generally up to No. 6) at the same time.

SUMMARY OF THE INVENTION

Therefore, the present invention considering this point is directed to providing a simultaneous ignition method for a hollow modular charge using a cluster laser, which is configured to combine a plurality of lasers in a cluster form to ignite a plurality of hollow propelling charge at the same time and simultaneously oscillates a laser beam to ignite all unit charges at the same time.

A simultaneous ignition cluster laser device for a hollow modular charge according to the present invention for achieving the above object includes a hollow modular charge with a charge inner diameter, and a laser cluster configured to ignite a gunpowder coating part of the charge inner diameter by radiating a laser, wherein the laser cluster maximizes an intensity of a laser beam radiated per unit area as it goes away from an inlet of the charge inner diameter by adjusting a path of the laser beam.

Preferably, the gunpowder coating part is black gunpowder coated on a surface of a propellant inside the charge inner diameter.

In addition, a simultaneous ignition cluster laser device for a hollow modular charge according to the present invention for achieving the above object includes a plurality of unit charges Nos. 1, 2, 3, 4, 5, and 6 having a charge inner diameter and arranged linearly, and a plurality of first, second, third, fourth, fifth, and sixth laser oscillators configured to ignite a gunpowder of the charge inner diameter through laser radiation that matches the unit charges Nos. 1, 2, 3, 4, 5, and 6 in a one-to-one matching manner.

Preferably, the first, second, third, fourth, fifth, and sixth laser oscillators are integrated at predetermined angular intervals to form a circular shape, and the first, second, third, fourth, fifth, and sixth laser oscillators form the circular shape at 60° intervals.

Preferably, the gunpowder coating part is black gunpowder coated on a surface of a propellant inside the charge inner diameter formed on each of the unit charges Nos. 1, 2, 3, 4, 5, and 6.

A simultaneous ignition method for a hollow modular charge using a cluster laser according to the present disclosure for achieving the above object includes positioning a laser cluster configured to oscillate a laser beam at an inlet of a charge inner diameter of the hollow modular charge, and radiating a laser from the laser cluster in a direction that is close to the inlet of a charge inner diameter and igniting a gunpowder coating part positioned at the inlet side of the charge inner diameter.

Preferably, the gunpowder coating part is black gunpowder coated on a surface of a propellant inside the charge inner diameter.

In addition, a simultaneous ignition method for a hollow modular charge using a cluster laser according to the present invention for achieving the above object includes positioning a first laser oscillator among a plurality of first, second, third, fourth, fifth, and sixth laser oscillators forming a circular shape at an inlet of a unit charge No. 1 among a plurality of unit charges Nos. 1, 2, 3, 4, 5, and 6 arranged linearly and radiating a laser from the first laser oscillator to a charge inner diameter of the unit charge No. 1 and igniting the gunpowder coating part, which is black powder, coated on a surface of a propellant inside the unit charge No. 1.

Preferably, when the position of the first laser oscillator facing the unit charge No. 1 is 0°, the laser radiation direction is matched in the order of the second laser oscillator and the unit charge No. 2, the third laser oscillator and the unit charge No. 3, the fourth laser oscillator and the unit charge No. 4, the fifth laser oscillator and the unit charge No. 5, and the sixth laser oscillator and the unit charge No. 6 for every 60° increase.

DETAILED DESCRIPTION OF THE INVENTION

Hereinafter, embodiments of the present invention will be described in detail with reference to the accompanying drawings, and these embodiments are examples and can be implemented in various different forms by those skilled in the art to which the present invention pertains, and thus are not limited to embodiments disclosed herein.

Figure 1:
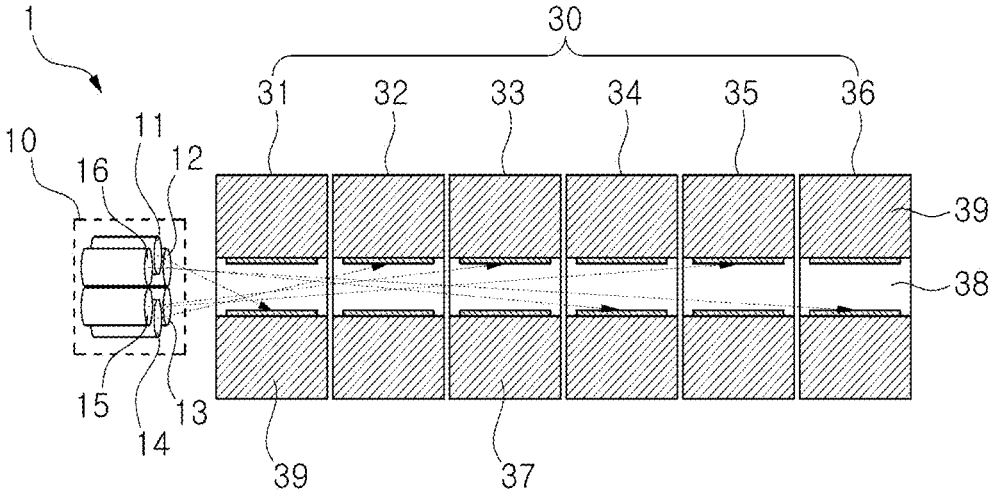
FIG. 1 is a configuration diagram of a simultaneous ignition cluster laser device for a hollow modular charge according to the present invention.
Figure 1:
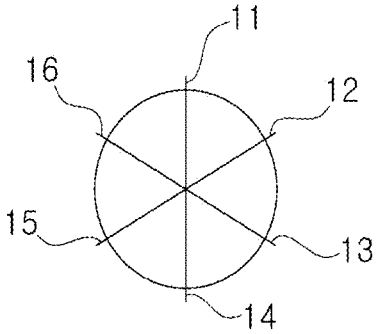

Referring to FIG. 1, a simultaneous ignition cluster laser device 1 is composed of a laser cluster 10 and a hollow modular charge 30.

The laser cluster 10 is composed of six first, second, third, fourth, fifth, and sixth laser oscillators 11, 12, 13, 14, 15, and 16 that are grouped in a circle, and each of the first, second, third, fourth, fifth, and sixth laser oscillators 11, 12, 13, 14, 15, and 16 radiates a high-power laser using a single spot laser beam.

The circular shape of the first, second, third, fourth, fifth, and sixth laser oscillators 11, 12, 13, 14, 15, and 16 is configured so that the first laser oscillator 11 and the fourth laser oscillator 14, the second laser oscillator 12 and the fifth laser oscillator 15, and the third laser oscillator 13 and the sixth laser oscillator 16 are each arranged at 180° in a polar coordinate system.

Therefore, when the first laser oscillator 11 is positioned at 0°, the second laser oscillator 12 is positioned at 60°, the third laser oscillator 13 is positioned at 120°, the fourth laser oscillator 14 is positioned at 180°, the fifth laser oscillator 15 is positioned at 240°, and the sixth laser oscillator 16 is positioned at 300°.

Therefore, a path of the laser beam is adjusted at an inlet of each of the first, second, third, fourth, fifth, and sixth laser oscillators 11, 12, 13, 14, 15, and 16 so that a laser may be radiated to inner diameter black powder coating parts of unit charges Nos. 1, 2, 3, 4, 5, and 6 31, 32, 33, 34, 35, and 36 that match the laser oscillators.

The hollow modular charge 30 is composed of six unit charges Nos. 1, 2, 3, 4, 5, and 6 31, 32, 33, 34, 35, and 36 that have a propellant 37, and each of the unit charges Nos. 1, 2, 3, 4, 5, and 6 31, 32, 33, 34, 35, and 36 is a hollow propelling charge having a charge inner diameter 38 drilled at a central portion thereof.

The unit charges Nos. 1, 2, 3, 4, 5, and 6 31, 32, 33, 34, 35, and 36 are arranged in series between the unit charge No. 1 31 and the unit charge No. 6 36 in the order of the unit charge No. 2 32, the unit charge No. 3 33, the unit charge No. 4 34, and the unit charge No. 5 35 to linearly align the charge inner diameters 38. In this case, the unit charges Nos. 1, 2, 3, 4, 5, and 6 31, 32, 33, 34, 35, and 36 may be named as unit charges Nos. 1 to 6.

In addition, each of the unit charges Nos. 1, 2, 3, 4, 5, and 6 31, 32, 33, 34, 35, and 36 includes a gunpowder coating part 39 on the propellant 37 in the charge inner diameter 38, and the gunpowder coating part 39 is formed using black gunpowder.

Therefore, the laser cluster 10 radiates a laser beam to the charge inner diameter 38 of the hollow modular charge 30, and the first laser oscillator 11 radiates a laser beam to a gunpowder coating part 39 of the unit charge No. 1 31, the second laser oscillator 12 radiates a laser beam to a gunpowder coating part 39 of the unit charge No. 2 32, the third laser oscillator 13 radiates a laser beam to a gunpowder coating part 39 of the unit charge No. 3 33, the fourth laser oscillator 14 radiates a laser beam to a gunpowder coating part 39 of the unit charge No. 4 34, the fifth laser oscillator 15 radiates a laser beam to a gunpowder coating part 39 of the unit charge No. 5 35, and the sixth laser oscillator 16 radiates a laser beam to a gunpowder coating part 39 of the unit charge No. 6 36.

Figure 2:
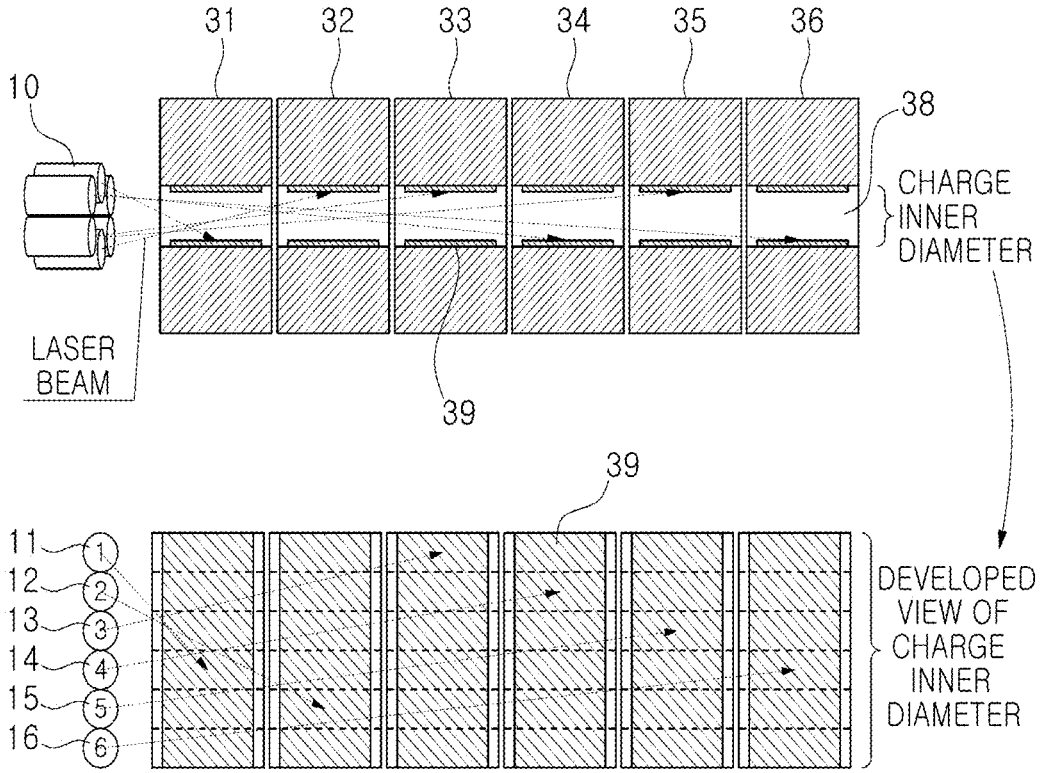
FIG. 2 shows a state in which first, second, third, fourth, fifth, and sixth laser oscillators of a laser cluster maximize the intensity of a laser beam per unit area radiated to each of unit charges 1, 2, 3, 4, 5, and 6 as in a developed view of a charge inner diameter of the hollow modular charge according to the present invention.

Referring to the developed view of the charge inner diameter of FIG. 2, in the description that the laser cluster 10 "radiates the inner diameter surface of the charge in the farthest direction," the "farthest direction" may be described in a state of increasing a 360° rotation region by 60°.

That is, this is a method of radiating a laser beam by matching the laser oscillator with the unit charge by refracting the path of the laser beam in the first laser oscillator 11 positioned at 0° (e.g., a 12 o'clock direction) to radiate the black gunpowder coating part at a 180° position (e.g., a 6 o'clock direction) of an inner diameter of the unit charge No. 1 31, refracting the path of the laser beam in the second laser oscillator 12 positioned at 60° (e.g., a 2 o'clock direction) to radiate the black gunpowder coating part at a 240° position (e.g., a 8 o'clock direction) of an inner diameter of the unit charge No. 2 32, refracting the path of the laser beam in the third laser oscillator 13 positioned at 120° (e.g., a 4 o'clock direction) to radiate the black gunpowder coating part at a 3000 position (e.g., a 10 o'clock direction) of an inner diameter of the unit charge No. 3 33, refracting the path of the laser beam in the fourth laser oscillator 14 positioned at 180° (e.g., a 6 o'clock direction) to radiate the black gunpowder coating part at a 0° position (e.g., a 12 o'clock direction) of an inner diameter of the unit charge No. 4 34, refracting the path of the laser beam in the fifth laser oscillator 15 positioned at 240° (e.g., a 8 o'clock direction) to radiate the black gunpowder coating part at a 60° position (e.g., a 2 o'clock direction) of an inner diameter of the unit charge No. 5 35, and refracting the path of the laser beam in the sixth laser oscillator 16 positioned at 300° (e.g., a 10 o'clock direction) to radiate the black gunpowder coating part at a 180° position (e.g., a 6 o'clock direction) of an inner diameter of the unit charge No. 6 36 among the first, second, third, fourth, fifth, and sixth laser oscillators 11, 12, 13, 14, 15, and 16.

This is to maximize the intensity of the laser beam radiated per unit area (i.e., minimize a reduction in intensity).

Meanwhile, the simultaneous ignition method for the hollow modular charge 30 using the cluster laser 10 includes positioning the laser cluster 10 for oscillating a laser beam at an inlet of the charge inner diameter 38 of the hollow modular charge 30 and radiating a laser from the laser cluster 10 in a direction that is close to the inlet of the charge inner diameter 38 and igniting the gunpowder coating part 39 positioned at the inlet side of the charge inner diameter 38. In this case, the gunpowder coating part 39 is black gunpowder coated on a surface of the propellant inside the charge inner diameter.

In addition, the simultaneous ignition method for the hollow modular charge 30 using the cluster laser 10 includes positioning the first laser oscillator 11 among the plurality of first, second, third, fourth, fifth, and sixth laser oscillators 11, 12, 13, 14, 15, and 16 forming a circular shape at an inlet of the unit charge No. 1 31 among the plurality of unit charges Nos. 1, 2, 3, 4, 5, and 6 31, 32, 33, 34, 35, and 36 arranged linearly and radiating a laser from the first laser oscillator 11 to the charge inner diameter 38 of the unit charge No. 1 31 and igniting the gunpowder coating part 39 of the unit charge No. 1 31.

In particular, when the position of the first laser oscillator facing the unit charge No. 1 is 0°, the laser radiation direction is matched in the order of the second laser oscillator and the unit charge No. 2, the third laser oscillator and the unit charge No. 3, the fourth laser oscillator and the unit charge No. 4, the fifth laser oscillator and the unit charge No. 5, and the sixth laser oscillator and the unit charge No. 6 for every 60° increase.

As described above, the simultaneous ignition method for the hollow modular charge using the cluster laser according to the present embodiment can maximize the intensity of the laser beam per unit area radiated to the gunpowder coating part 39 by adjusting the path of the laser beam from the first, second, third, fourth, fifth, and sixth laser oscillators 11, 12, 13, 14, 15, and 16 igniting the gunpowder coating parts 39 through one-to-one matching with the unit charges Nos. 1, 2, 3, 4, 5, and 6 31, 32, 33, 34, 35, and 36 having the charge inner diameter 38 as they goes away due to the linear arrangement of the unit charges Nos. 1, 2, 3, 4, 5, and 6 31, 32, 33, 34, 35, and 36, thereby simultaneously igniting the plurality of lasers in a cluster-shaped combination.

The simultaneous ignition method for the hollow modular charge using the cluster laser according to the present invention can simultaneously ignite all of the plurality of hollow propelling charges, thereby minimizing ignition delay.

What is claimed is:

1. A simultaneous ignition cluster laser device for a hollow modular charge, comprising:

a hollow modular charge with a charge inner bore; and a laser cluster configured to ignite a gunpowder coating part of the charge inner bore by radiating a laser, wherein the laser cluster maximizes an intensity of a laser beam radiated per unit area as the laser beam shifts away from an inlet of the charge inner bore by adjusting a path of the laser beam, wherein the hollow modular charge comprises a plurality of unit charges Nos. 1, 2, 3, 4, 5, and 6 arranged linearly along the charge inner bore, and the laser cluster comprises a plurality of first, second, third, fourth, fifth, and sixth laser oscillators respectively corresponding to the unit charges Nos. 1, 2, 3, 4, 5, and 6 in a one-to-one matching manner, wherein each of the first, second, third, fourth, fifth, and sixth laser oscillators adjusts the path of the laser beam as the laser beam propagates over an increased distance due to the linear arrangement of the unit charges Nos. 1, 2, 3, 4, 5, and 6, and the adjustment of the path of the laser beam maximizes an intensity of the laser beam per unit area radiated to each of the unit charges Nos. 1, 2, 3, 4, 5, and 6.

2. The simultaneous ignition cluster laser device of claim 1, wherein the gunpowder coating part is black gunpowder.

3. The simultaneous ignition cluster laser device of claim 1, wherein the first, second, third, fourth, fifth, and sixth laser oscillators are integrated at predetermined angular intervals to form a circular shape.

4. The simultaneous ignition cluster laser device of claim 3, wherein the first, second, third, fourth, fifth, and sixth laser oscillators form the circular shape at 60° intervals.

5. The simultaneous ignition cluster laser device of claim 1, wherein the laser oscillators are configured such that, with respect to a direction of the laser radiation, the laser oscillators sequentially correspond to the unit charges by refracting the path of the laser beam so that:

the first laser oscillator positioned at 0° radiates the laser beam to the gunpowder coating part at a 180° position of an inner bore of the unit charge No. 1, the second laser oscillator positioned at 60° radiates the laser beam to the gunpowder coating part at a 240° position of an inner bore diameter of the unit charge No. 2, the third laser oscillator positioned at 120° to radiates the laser beam to the gunpowder coating part at a 300° position of an inner bore of the unit charge No. 3, the fourth laser oscillator positioned at 180° to radiates the laser beam to the gunpowder coating part at a 0° position of an inner bore of the unit charge No. 4, the fifth laser oscillator positioned at 240° to radiates the laser beam to the gunpowder coating part at a 60° position of an inner bore of the unit charge No. 5, and the sixth laser oscillator positioned at 300° to radiates the laser beam to the gunpowder coating part at a 180° position of an inner bore of the unit charge No. 6.

6. The simultaneous ignition cluster laser device of claim 5, wherein the unit charge No. 6 forms the path of the laser beam in a farthest direction among the unit charges Nos. 1, 2, 3, 4, 5, and 6.

* * * * *